US005439326A

United States Patent [19]

Goughnour et al.

[11] Patent Number: 5,439,326

[45] Date of Patent: Aug. 8, 1995

[54] APPARATUS FOR INSERTING PREFABRICATED VERTICAL DRAINS INTO THE EARTH

[75] Inventors: R. Robert Goughnour, Leesburg, Va.; T. Richard Morris, Matthews, N.C.

[73] Assignee: Geotechnics America, Inc., Peachtree City, Ga.

[21] Appl. No.: 46,848

[22] Filed: Apr. 14, 1993

[51] Int. Cl.[6] ..... E02D 3/10; E02D 7/00

[52] U.S. Cl. ..... 405/303; 405/50; 405/232

[58] Field of Search ..... 405/50, 228, 232, 303; 52/651.01, 651.05, 651.07; 175/220; 173/184, 185, 28

[56] References Cited

U.S. PATENT DOCUMENTS

| | | | |
|---|---|---|---|
| 793,651 | 7/1905 | Fessenden | 52/651.01 X |
| 2,980,411 | 4/1961 | Buckholdt | 226/196 X |
| 4,755,080 | 7/1988 | Cortlever et al. | 405/50 |
| 5,213,449 | 5/1993 | Morris | 405/232 |

FOREIGN PATENT DOCUMENTS

| | | | |
|---|---|---|---|
| 646986 | 10/1962 | Italy | 52/651.01 |

*Primary Examiner*—David H. Corbin
*Attorney, Agent, or Firm*—Carothers & Carothers

[57] ABSTRACT

Apparatus for inserting an elongated flexible prefabricated vertical (PV) drain downwardly into the earth. The apparatus includes a vertical mast having a lower standard mast base and a lightweight extra long mast extension. A vehicle supports the mast from its mast base in order to raise and lower the mast to and from vertical and to otherwise manipulate and transport the mast in a conventional manner. A longitudinal chamber extends for the entire length of the mast and carries therein an earth penetrating tube for vertical movement. This earth penetrating tube also has a passage therethrough for receiving the elongated flexible PV drain for movement with this insertion tube down into the earth when driven therein. The mast extension includes a series of axially aligned extension tubes constructed of light weight material and removably connected together end to end, and a combination spar and guy mechanism is utilized for supporting this long mast extension from the relatively short mast base. The elongated flexible PV drain is fed up the mast through a feed tube, over the top of the mast and back down through the internal passage of this earth penetrating tube. This entire combined passage way is made substantially air tight so that a feed line may be blown therethrough with compressed air assistance in order to provide a feed line for pulling a new elongated flexible PV drain through the passage.

7 Claims, 3 Drawing Sheets

APPARATUS FOR INSERTING PREFABRICATED VERTICAL DRAINS INTO THE EARTH

BACKGROUND OF THE INVENTION

This invention relates generally to apparatus for inserting prefabricated vertical (PV) drains (sometimes referred to as wick or band drains) into the earth, and more specifically to an improved apparatus for inserting PV drains of extra ordinary length into the earth.

One well known technique for preparing soil that has a high moisture content, such as wet clay, for example, is to drive into the soil a drainage element that penetrates deep into the soil with the top end of the drainage element maintained above the surface of the soil. The PV drain is formed of any suitable material which is water permeable, or perforated to be water permeable, so that the water in the soil can penetrate the walls of the drain and flow upwardly therein to the surface of the soil as a result of water pressures in the soil beneath the surface. It is common practice in such situations to increase these inherent water pressures in the soil by placing a layer of earth on top of the wet soil so that the weight thereof will assist in forcing the water into and upwardly through the PV drains, where the water can be readily disbursed.

The PV drain is generally elongated and flexible and it is carried into the ground by utilizing a rigid insertion tube formed of a suitable metal. This insertion tube, together with the drain, is driven downwardly into the earth to the desired depth and then the insertion tube is pulled out of the soil thereby leaving the PV drain. The drains are inserted at regular predetermined intervals in the earth, depending upon the soil conditions and moisture content.

This rigid insertion tube which carries the elongated flexible PV drain therein, is adapted for vertical movement within a mast. The insertion tube is generally driven downwardly into the earth and retracted therefrom with a drive mechanism. This drive mechanism is preferably positioned at the bottom or lower end of the mast, and by way of example, may consist of a pair of friction rollers, or even more preferably, a gear drive mechanism which is positioned at the lower end of the mast as disclosed in copending U.S. patent application Ser. No. 726,589 filed on Jul. 8, 1991 for APPARATUS FOR INSERTING WICK DRAINS INTO THE EARTH now U.S. Pat. No. 5,213,449, which is incorporated herein by reference. Normally a vehicle is provided which supports the mast at its base and is further adapted to raise and lower the mast to and from vertical and to otherwise manipulate and transport the mast.

Extra ordinary problems arise in the situation where the PV drains must be deeper than ordinary. Typically the PV drains must be provided to a depth of 20 to 70 feet maximum. However, unusual situations may be encountered wherein the PV drains must be driven to much greater depths, such as 150 feet.

The insertion tubes which are provided to carry the drainage element down into the earth must be as long as the desired depth of the drain to be inserted. Accordingly, the typical mast which carries the insertion tube, needs to be at least as long as the insertion tube. Thus, for normal circumstances, the mast needs to be only approximately 70 feet high. The vehicle designed to raise and lower such a mast and otherwise position and transport such a mast is conventional in design and can readily manipulate a standard mast structure of only 70 foot height.

However, very difficult circumstances are encountered in situations where the mast must be much longer, for example 150 feet. A mast of conventional structure of 150 foot length is very heavy and unwieldy. In this situation the size of the support vehicle must be increased in order to even support and manipulate the mast while in a vertical position.

A standard mast of this length cannot practically be raised and lowered by the support vehicle for two reasons. First, the overturning moment required to raise the mast from the horizontal to the vertical is excessive, and would require special auxiliary weights to prevent the support vehicle from overturning. If a motorized vehicle of sufficient mass and bulk were developed to manipulate a standard mast of 150 foot length, the cost of construction and transport of such a vehicle would be unreasonably prohibitive. Secondly, the mast itself cannot sustain these moments. If the mast were strengthened to sustain the required moment, then moment applied to the support vehicle would increase. It would be necessary to utilize an auxiliary crane to erect and to dismantle such equipment.

Often an additional problem exists when the working surface is extremely soft. For example, when extensive channel dredging occurs to widen and deepen navigable water channels, the deposits from such dredging operations create additional land masses or islands. The moisture content of these dredge deposits is extremely excessive. In fact, if one were to walk on such land as created by dredging deposits, one would normally sink up to hip level. The only practical way to stabilize such newly formed islands or land deposits is to insert PV drains at predetermined intervals down into the newly deposited earth. However, in order to be effective, the PV drains must be inserted to depths in the area of 150 feet.

Although a crust eventually forms at the surface of these deposits, this crust is only a few inches thick, and is easily broken. Moving normal construction equipment over these sites is not possible, even using standard construction mats, and special flotation equipment has been developed to carry the construction equipment. Providing equipment to mount an installation mast of the required length for such conditions is impractical, if not impossible, using conventional equipment.

It is accordingly an object of the present invention to provide an apparatus for inserting PV drains into the earth of excessive length, for example 150 feet, by providing a light weight mast structure which may still be readily manipulated by a conventional crane manipulation vehicle without the required assistance of a helper crane, and readily disassembled and transported from work site to work site.

In addition, it is also desirable to be able to have only one vehicle for raising and lowering such a high mast with ease and without assistance so that when high wind conditions are encountered the single vehicle may simply lower the mast structure quickly by itself, without additional helper crane assistance, and without the requirement of a mechanic physically climbing the tower structure to assist in manipulating the mast by making connections from other assisting helper crane structures to the mast structure.

The present invention permits one to construct a mast of extra ordinary length for inserting flexible drain members into the earth, yet still permitting such a long or tall mast to be manipulated by conventional techniques with one or a single vehicle manipulating the mast in the conventional cantilevered manner.

Another object of the present invention is to provide a novel method for initially feeding and loading such a PV drain insertion apparatus with a continuous or endless flexible drain wick supplied from a feed reel mounted on vehicle. This can be done without the need of a man climbing the mast, as required for conventional mast equipment.

SUMMARY OF THE INVENTION

The apparatus of the present invention for inserting elongated flexible drain members downwardly into the earth comprises a vehicle carried mast adapted to be arranged with a generally vertical extent above the earth. The mast is provided or formed with a lower standard mast base and with an upper light weight, extra long mast extension, so that the extra long mast can still be manipulated by a single vehicle to raise, lower, transport and otherwise manipulate the extra long mast.

The vehicle that supports this extra long mast, supports it by the mast base and is adapted to raise and lower the mast to and from vertical, and to otherwise manipulate and transport said mast, from the standard mast base.

The entire mast is provided with a longitudinally extending chamber therein and an earth penetrating tube member is carried for vertical movement in this longitudinal chamber of the mast. In addition, this tube member has a passage therethrough for receiving an elongated flexible drain member or PV drain for movement with this tube member when it is driven downwardly into the earth for insertion of the drain.

A drive mechanism is positioned on the mast base for driving this tube member into the underlying earth together with the drain member and out from the underlying earth alone, leaving the drain member buried to the desired extraordinary depth, of, for example, approximately 150 feet or so.

The mast extension provides the major portion of the mast height and must be exceptionally light weight so that the extra tall mast may still be manipulated by the vehicle supporting the mast base. This mast extension includes a series of extension tubes constructed of light weight material which are axially aligned with the extension tubes connected together in an end to end fashion. In addition, a combination spar and guy mechanism is utilized for supporting these mast extension tubes from the mast base.

These mast extension tubes are separably connected together, such as by bolted end flanges or the like, for disassembly and transport. The mast extension assembly may be assembled and disassembled on one site and then moved, together with the vehicle, to another site by truck or rail and there reassembled for operation and further insertion of drainage wicks.

The combination spar and guy mechanism utilized to support the upper mast extension on top of the standard mast base, generally consists of multiple spaced compression spars extending outwardly from the standard mast base adjacent the upper end thereof together with a number of guys, such as guy cables or rods. Such guys run from the outer ends of these compression spars to the respective upper ends of the extension tubes, and also to the mast base adjacent the lower end thereof. This provides an overall extremely tall mast structure to accommodate extra long PV drains without imparting undue weight to the mast structure, thereby permitting the vehicle to individually and independently manipulate the mast structure up and down and otherwise without the assistance of additional expensive helper vehicle equipment.

The extension tubes may be constructed of any strong light weight material, such as an aluminum alloy.

Also, it is preferable that the drive mechanism which drives the earth penetrating tube member, together with PV drain contained in the interior thereof, downwardly into the earth, be driven by a drive mechanism which is positioned at the lower end of the conventional or standard mast base in order to provide this added weight of the drive mechanism as low as possible on the mast structure. This provides further ease of manipulation by the vehicle supporting and manipulating the mast.

Another disadvantage with the PV drain insertion apparatus of the prior art is that there is no easy or quick method for inserting new elongated PV drains up the mast, over the top and then down the mast again, when the elongated flexible PV drain member either breaks or is totally spent from the supply reel at the base of the mast. It is necessary for a man to climb the mast to accomplish rethreading. This problem even becomes much more difficult when dealing with such a high mast as provided for the apparatus of the present invention.

A PV drain member feed tube, having a passage therethrough is also provided for the mast and runs parallel to and substantially coextensive with the mast for receiving an elongated flexible drain member up through the inner passage thereof, over the top, and then back down through the tube member which is utilized to drive the drain down into the earth.

A turnabout mechanism is provided at the top of the mast to assist in the feed of the elongated flexible drain member or PV drain over the top of the mast and back down the interior of the tube member passage. This turnabout mechanism is provided with an inverted U-shaped passage for feed of the drain member over the top of the mast and then down again.

This feed tube passage in combination with the inverted U-shaped passage of the upper turnabout member, in further combination with the tube member passage, or passage within the tube member utilized to insert the PV drain into the earth, all serially communicate with each other for providing a combined conduit passage which is substantially air tight, when the tube member is supported in its upper most position within the longitudinal chamber of the mast. In this position, one can feed a new flexible elongated drain member or PV drain through this entire combination conduit passage by merely blowing a feed line through the conduit passage with compressed air and the assistance of a lead missile, such as a ball or the like which is secured or tethered to the end of the feed line. The ball or missile is then blown through the substantially air tight passage series, thereby carrying the feed line with it.

Thereafter, a new elongated flexible drain member or PV drain end may be tied to one end of the feed line and the drain is easily pulled through the entire series of conduit passages with the feed line for further operation of the apparatus.

BRIEF DESCRIPTION OF THE DRAWINGS

Other objects and advantages appear in the following description and claims.

The accompanying drawings show, for the purpose of exemplification, without limiting the invention or claims thereto, certain practical embodiments illustrating the principals of this invention, wherein:

DESCRIPTION OF THE PREFERRED EMBODIMENT

Figure 1:
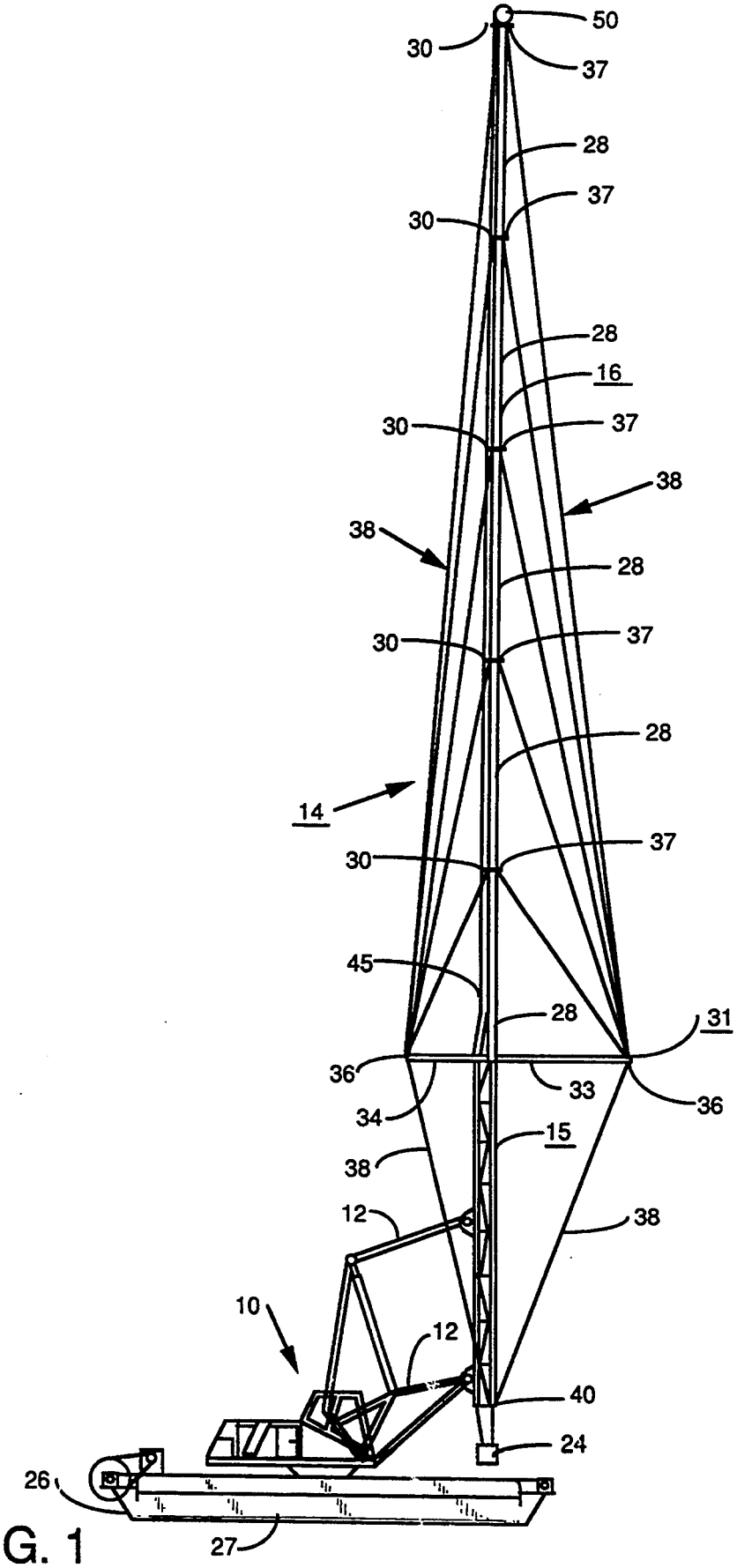
FIG. 1 is a general view in vertical side elevation illustrating the apparatus of the present invention.
Figure 2:
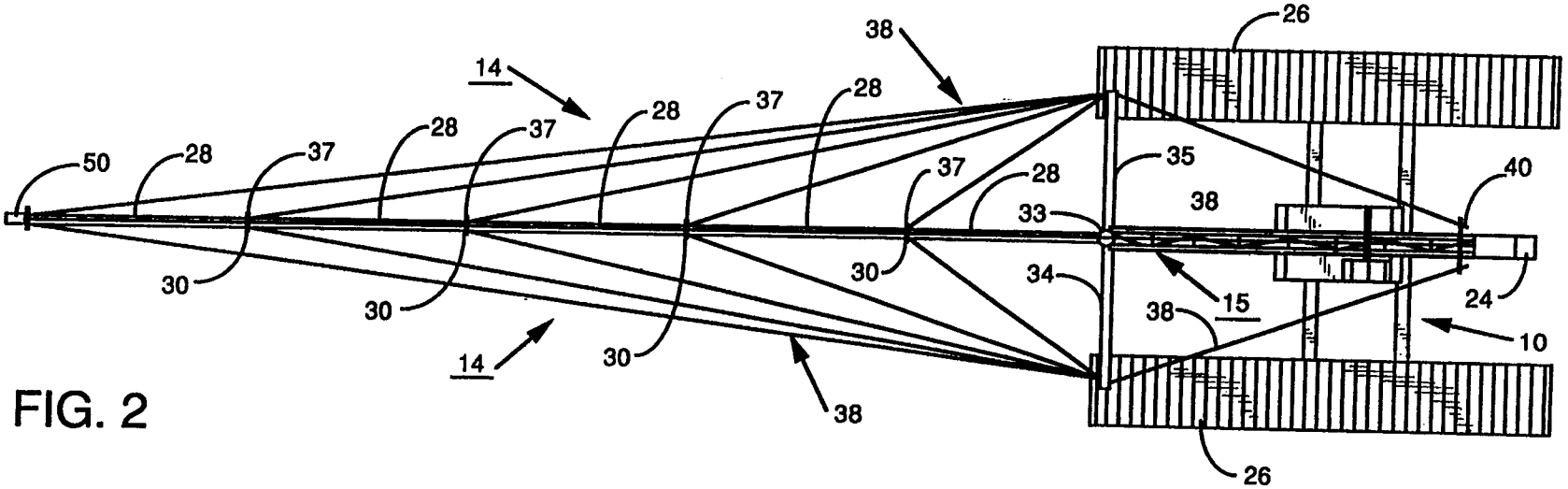
FIG. 2 is a general top or plan view illustrating the apparatus of FIG. 1 with the mast structure thereof shown in a lowered or horizontal position.
Figure 3:
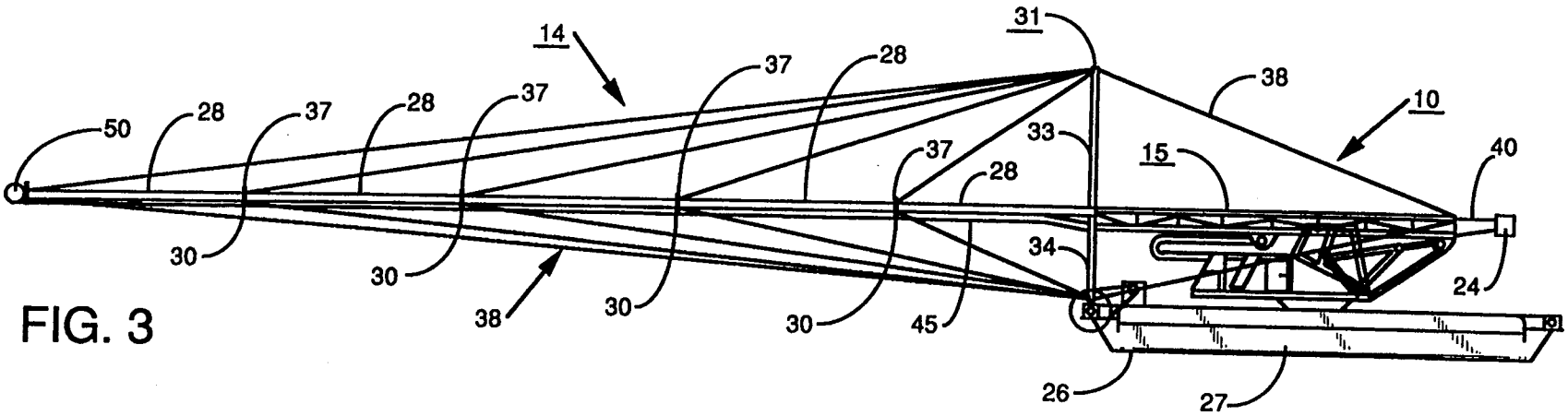
FIG. 3 is a general view in side elevation illustrating the apparatus of FIGS. 1 and 2 with the mast structure thereof shown in its lowered or horizontal position.

Referring now to FIGS. 1, 2 and 3, these figures illustrate the drain inserting apparatus as including a vehicle 10, which may be of any suitable type, for supporting and manipulating the mast 14 with manipulating arms 12. Mast 14 is shown in its lowered or horizontal position in FIGS. 2 and 3. Mast 14 is constructed or formed into two basic parts. In particular the mast 14 is constructed with a lower standard mast base 515 and a much longer or taller light weight mast extension 16.

The entire mast structure 14 is provided with a longitudinally extending chamber therein and basically throughout the entire length of mast 14. This longitudinally extending chamber is designated as reference numeral 17 in FIGS. 4, 5 and 6.

The vehicle 10 is adapted to support the mast 14 from its mast base 15 and is adapted to raise the mast from its lowered or horizontal position as seen in FIGS. 2 and 3 to a vertical position as illustrated in FIG. 1, or to lower the mast from its vertical position as shown in FIG. 1 to its lowered or horizontal position as illustrated in FIGS. 2 and 3, and to otherwise manipulate and transport the mast from one location to another. Manipulation of the mast base 15 is carried out from vehicle 10 through conventional drive mechanisms and manipulating arms 12. Except for the inventive features of the present invention, the apparatus described herein functions in a manner identical to that shown and described in U.S. Pat. No. 5,213,449.

Figure 4:
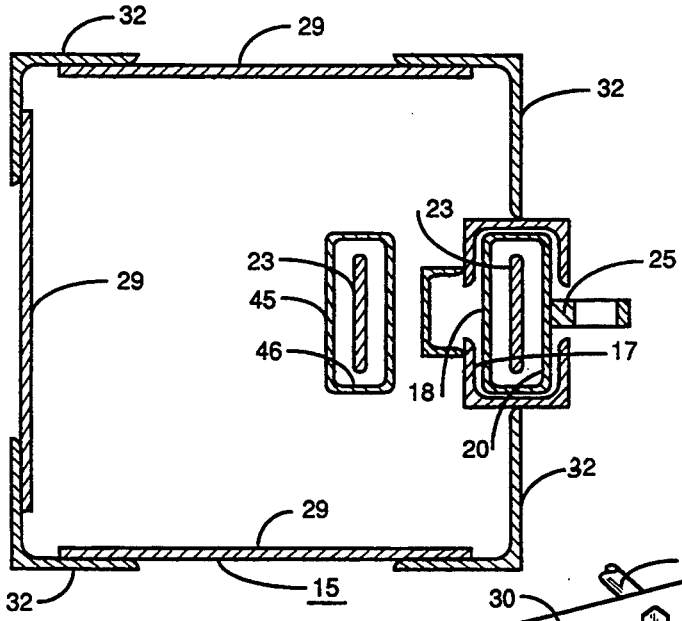
FIG. 4 is a sectional view taken along a horizontal plane in the lower standard mast base portion of the mast structure of the apparatus illustrated in FIG. 1.
Figure 5:
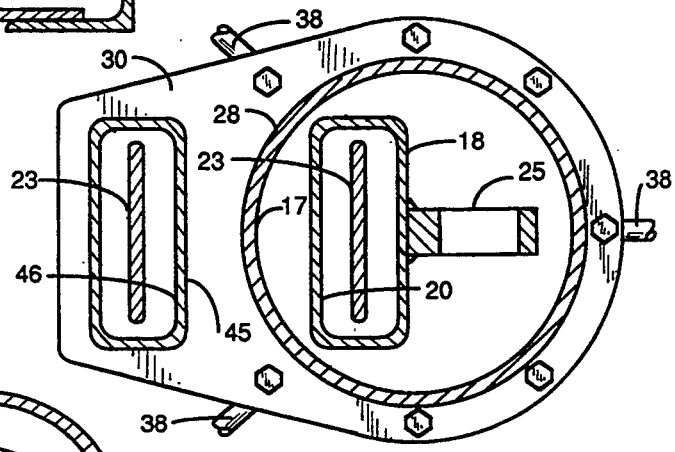
FIG. 5 is a sectional view taken along a horizontal plane in the upper light weight mast extension portion of the mast structure of the apparatus illustrated in FIG. 1.
Figure 6:
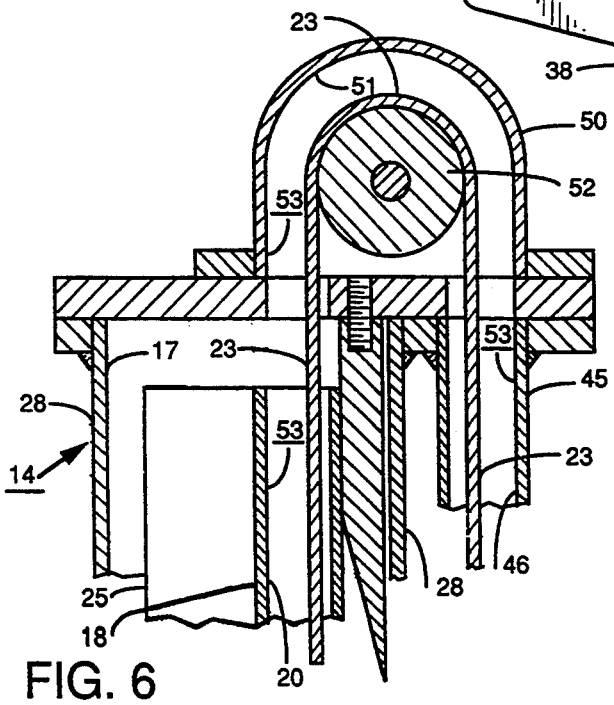
FIG. 6 is a detailed view in vertical center cross section as seen from the back side of the top most portion of the mast structure of the apparatus illustrated in FIG. 1.

With additional reference to FIGS. 4, 5 and 6, an earth penetrating tube member 18, which is substantially the same length or height as mast 14, is carried for vertical or longitudinal movement within the longitudinal chamber 17 of mast 14. In addition, this tube member 18 is also provided with a passage 20 therethrough for receiving an elongated flexible drain member or PV drain 23 for movement with tube member 18 when it is driven downwardly into the earth. The end of the PV drain 23 is anchored in any conventional manner at the bottom end of the insertion tube member 18 as is conventionally done and described in U.S. Pat. No. 5,213,449 with regard to insertion tube 16 and drainage wick 22 described therein. Thus when insertion tube member 18 is driven into the earth it will carry the PV drain 23 with it and otherwise move the PV drain through the tube structure.

The drive means for driving the tube member 18 together with its interior drain 23 downwardly into the earth, and for thereafter withdrawing the tube member 18 upwardly out of the earth, while leaving the drain behind, is preferably mounted on mast 14 at the bottom or adjacent the lower end of mast base 15 as indicated at 24.

As previously indicated, this positioning provides the lowest possible center of gravity mounting for the drive structure on the mast 14, which assists in easy manipulation of the mast 14 by vehicle 10. This drive mechanism 24, is shown in detail as drive system 18 in FIG. 4 of copending U.S. patent application Ser. No. 726,589, filed Jul. 8, 1991, for APPARATUS FOR INSERTING WICK DRAINS INTO THE EARTH now U.S. Pat. No. 5,213,449 which is incorporated herein by reference. This drive system 24 generally includes a drive gear which is mounted for rotation through a conventional gear reduction to drive the elongated slotted rack gear appendage 25 secured to the side of tube member 18 for substantially its entire length or height.

The vehicle 10 is also provided with conventional motor driven tracks 26 which are driven in a conventional manner over pontoon floats 27 to move vehicle 10 in any desired direction over the earth to transport and position mast 14 to a desired location for insertion of a PV drain.

The mast extension 16 includes a series of light weight aluminum alloy extension tubes 28. These extension tubes 28 are axially aligned and connected together end to end in a conventional manner through bolted end flanges 30, which are welded to opposite ends of each of the extension tubes 28. The details of the flanges 30 are best seen in FIG. 5. The extension tubes 28 may be readily separated at their respective end flanges 30 through the use of conventional bolts as illustrated for disassembly and transport to a new site or work location.

A combination spar and guy support mechanism 31 is connected and utilized for supporting the mast extension 16 from the mast base 15.

Details of the standard mast base section 15 are best illustrated in FIG. 4.

Conventional mast base 15 is constructed in a standard manner from vertical angle irons 32 and conventional steel cross bracing 29, which welds the vertical members together in a conventional solid mast structure.

The combination spar and guy support 31 is shown to generally include three multiple spaced compression spars 33, 34 and 35 which extend outwardly from the upper end of mast base 15, and guys or guy rods or wires 38 run from the outer ends 36 of spars 33, 34 and 35 to the upper ends 37 of the respective extension tubes 28, and also to the mast base 15 adjacent the lower ends thereof as indicated at 40.

The entire apparatus may be assembled and disassembled on site. The vehicle 10 itself may be delivered in parts and assembled on the work site together with its base mast portion 15. With mast base 15 in its lowered or horizontal position, as illustrated in FIGS. 2 and 3, mast extension tubes 28 may be successively and serially mounted to the outer or upper end of mast base 15 and the respective guy rods or wires 38 connected to the mounted spars 33, 34 and 35 as the extension tubes are secured into position. This permits the entire extremely high or long mast extension 16 to be transported from one work site to another in an extremely compact manner.

With further reference to all of the figures and with special reference to FIG. 6, the mast 14 is provided with the drain member feed tube 45 which has a passage 46 therethrough. This drain member feed tube 45 together with its internal passage 46 runs generally parallel to and substantially coextensive with mast 14, and is adapted for receiving an elongated flexible drain member 23 up through the drain feed tube passage 46 and then over the top of mast 14 and back down through tube drain feed insertion member passage 20 of drain tube insertion member 18.

With particular reference to FIG. 6, a turnabout mechanism 50 is positioned at the top of mast 14 and has an inverted U-shaped passage 51 therein for assisting the feed of elongated flexible drain member 23 over the top of mast 14, or over the top of roller 52 and back down into the passage 20 of tube member 18.

The insertion of the PV drain 22 into the passage 46 of extension tubes 28 and the storage of the PV drain member before it is installed is accomplished in a conventional manner as is described in U.S. Pat. No. 5,213,449. PV drain 23 is fed or passes upwardly through passage 46 from any suitable source, such as a supply roll (not shown) on which the PV drain 22 is wound. In a known and conventional manner, the PV drain 22 extends upwardly through passage 46 of mast 14, over turnabout mechanism 50 and back down passage 20 of insertion tube member 18, wherein the end of the PV member 23 is anchored.

The feed tube passage 46 in combination with this inverted U-shaped passage 51 of the top turnabout member 50, in further combination with the tube member passage 20 of member 18, are serially combined such that these respective passages communicate with each other for providing a combined conduit passage 53. Conduit passage 53 is substantially air tight in its construction when the tube member 18 is supported in its upper most position in mast 14 within chamber 17 as is illustrated in FIG. 6.

Accordingly, a feed line or lanyard (not shown) may be literally blown through this entire conduit passage 53 by conventional air compressor means and the use of a lead guide missile, such as, a ball or the like (not shown), to which one end of the feed line is tethered.

In this fashion, a feed line may be blown through the entire conduit 53 and thereafter one end of the feed line may be tied to the end of a new elongated flexible drain member 23, which may thereafter be drawn through the entire conduit passage 53 by such a lead line for initially feeding and loading the apparatus with a drain member.

We claim:

1. Apparatus for inserting flexible drain members downwardly into earth, said apparatus comprising:

a) a mast adapted to be arranged with a generally vertical extent above the earth, said mast being formed of a lower mast base and an upper light weight mast extension, and having therein a longitudinally extending chamber;

b) a vehicle supporting said mast base and adapted to raise and lower said mast to and from vertical and to otherwise manipulate and transport said mast;

c) an earth penetrating tube member carried for vertical movement in said longitudinal chamber of said mast, said tube member having a passage therethrough for receiving an elongated flexible drain member for movement therewith;

d) drive means positioned on said mast base for driving said tube member into and out of underlying earth;

e) said mast extension including a series of axially aligned extension tubes constructed of light weight material and connected together end to end, and combination spar and guy means connected for supporting said mast extension from said mast base.

2. The apparatus of claim 1 wherein said extension tubes are separably connected for disassembly and transport.

3. The apparatus of claim 2 wherein said mast base has an upper end and a lower end and said combination spar and guy means includes multiple spaced compression spars extending outwardly from said mast base adjacent the upper end thereof and guys running from the outer ends of said spars to upper ends of said extension tubes and to said mast base adjacent the lower end thereof.

4. The apparatus of claim 3 wherein said extension tubes are constructed of aluminum alloy.

5. The apparatus of claim 1 wherein said mast base has an upper end and a lower end and said drive means is positioned adjacent the lower end of said mast base.

6. The apparatus of claim 1 wherein said mast includes, a drain member feed tube having a passage therethrough and running parallel to and substantially coextensive with said mast for receiving an elongated flexible drain member up through said passage and then back down through said tube member, and turnabout means positioned at the top of said mast and having an inverted U-shaped passage for assisting the feed of an elongated flexible drain member over the top of said mast; said feed tube passage, said inverted U-shaped passage and said tube member passage serially communicating with each other for providing a combined conduit passage which is substantially air tight when said tube member is supported in an uppermost position within said mast longitudinal chamber for permitting the blowing of a feed line through said conduit passage to thereafter pull a drain member therethrough.

7. An apparatus for inserting flexible drain members downwardly into earth,said apparatus comprising:

a) a mast adapted to be arranged with a generally vertical extent above the earth and having therein a longitudinally extending chamber;

b) an earth penetrating tube member carried for vertical movement in said longitudinal chamber, said tube member having a passage therethrough for receiving an elongated flexible drain member for movement therewith;

c) drive means positioned on said mast for driving said tube member into and out of underlying earth;

d) a drain member feed tube having a passage therethrough and secured in parallel to and substantially coextensive with said mast for receiving a flexible elongated drain member up through said feed tube passage; and e) turnabout means positioned at the top of said mast and having an inverted U-shaped passage for assisting the feed of an elongated flexible drain member from said feed tube passage back down through said tube member passage;

f) said feed tube passage, said inverted U-shaped passage and said tube member passage serially communicating with each other for providing a combined conduit passage which is substantially air tight when said tube member is supported in an uppermost position within said longitudinal chamber of said mast for permitting the blowing of a feed line through said conduit passage to thereafter pull a drain member therethrough.

* * * * *